US008246143B2

(12) United States Patent
Ogawa

(10) Patent No.: US 8,246,143 B2
(45) Date of Patent: Aug. 21, 2012

(54) IMAGE RECORDING APPARATUS

(75) Inventor: Mikio Ogawa, Nagoya (JP)

(73) Assignee: Brother Kogyo Kabushiki Kaisha, Aich-ken (JP)

( * ) Notice: Subject to any disclaimer, the term of this patent is extended or adjusted under 35 U.S.C. 154(b) by 296 days.

(21) Appl. No.: 12/731,735

(22) Filed: Mar. 25, 2010

(65) Prior Publication Data

US 2011/0074874 A1 Mar. 31, 2011

(30) Foreign Application Priority Data

Sep. 30, 2009 (JP) ..... 2009-227827

(51) Int. Cl.
*B41J 2/165* (2006.01)

(52) U.S. Cl. ..... 347/32

(58) Field of Classification Search ..... None
See application file for complete search history.

(56) References Cited

U.S. PATENT DOCUMENTS

| | | | | |
|---|---|---|---|---|
| 6,918,648 | B2 * | 7/2005 | Tee et al. | 347/29 |
| 7,722,155 | B2 * | 5/2010 | Takahashi et al. | 347/33 |
| 2003/0020779 | A1 | 1/2003 | Takahashi | |
| 2009/0102884 | A1 * | 4/2009 | Kawakami | 347/32 |

FOREIGN PATENT DOCUMENTS

| | | | |
|---|---|---|---|
| JP | 2002-307699 | A | 10/2002 |
| JP | 2002-307701 | A | 10/2002 |
| JP | 2004-066755 | A | 3/2004 |

* cited by examiner

*Primary Examiner* — Matthew Luu
*Assistant Examiner* — Alejandro Valencia
(74) *Attorney, Agent, or Firm* — Scully, Scott, Murphy & Presser, PC

(57) ABSTRACT

An image recording apparatus wherein a first rack gear is not meshed with a second pinion gear when the second pinion gear faces a first moving end of a slide cam or when the second pinion gear faces a second moving end of the cam, and is meshed with the second pinion gear when a portion of the cam which faces the second pinion gear is displaced between the first and second moving ends, wherein a second rack gear is meshed with a third pinion gear over an area of the cam between the first and second moving ends, wherein teeth of a tooth chipped gear are partly chipped such that the second pinion gear faces the area of the cam, and wherein the second pinion gear is rotated relative to the third pinion gear due to play at least until the tooth chipped gear is meshed with a drive gear.

10 Claims, 10 Drawing Sheets

IMAGE RECORDING APPARATUS

CROSS REFERENCE TO RELATED APPLICATION

The present application claims priority from Japanese Patent Application No. 2009-227827, which was filed on Sep. 30, 2009, the disclosure of which is herein incorporated by reference in its entirety.

BACKGROUND OF THE INVENTION

1. Field of the Invention

The present invention relates to an image recording apparatus such as an ink-jet recording apparatus configured to perform image recording by ejecting ink droplets from a recording head onto a recording medium. More particularly, the present invention relates to an image recording apparatus including a cap which covers ink-ejection openings of the recording head and which is slidable between a position at which the cap covers the ink-ejection openings and a position at which the cap is distant from the ink-ejection openings, in order to perform a purging operation in which the ink is sucked and discharged from the recording head by a sucking pump.

2. Description of the Related Art

There is conventionally known an apparatus configured to record various images such as a character, a picture, and a wiring pattern by ejecting liquid droplets. For example, there is known an image recording apparatus configured to record an image on a sheet by ejecting ink on the basis of input signals. This type of the image recording apparatus is generally referred to as an "ink-jet printer". The image recording of the ink-jet printer is performed by selective ejection of the ink from ink-ejection openings of a recording head.

In the recording head, there may arise a case of generation of air bubbles and/or clogging of foreign materials in ink passages respectively leading to the ink-ejection openings. These generation and clogging may adversely affect the ejection of the ink droplets from the recording head. In order to prevent or recover this adverse affection, there is known a technique for removing the air bubbles and the foreign materials from the ink-ejection openings of the recording head. This technique is generally referred to as "purging". This purging is performed by a maintenance unit. The maintenance unit includes: a cap for covering the ink-ejection openings of the recording head; a pump for absorbing the ink by reducing a pressure in the cap; a waste ink tank for storing the absorbed ink; a tube connecting the pump and the waste ink tank; and so on.

When the image recording is performed on the sheet, the recording head is movable in a direction perpendicular to a sheet feeding direction in which the sheet is fed. In this time, the cap is distant from the ink-ejection openings of the recording head. When the purging is performed, the ink-ejection openings of the recording head are covered with the cap, so that an airtight space is formed between the recording head and the cap. When the pump is driven in this state, the ink is absorbed. As thus described, the ink-jet printer includes a cap lifting mechanism which causes the cap to slide between a position at which the cap covers the ink-ejection openings by closely contacting the recording head and a position at which the cap is distant from the recording head. A friction clutch mechanism may be used as a means for the sliding of the cap.

For example, there is known an ink-jet printer in which a gear driven by a drive force transmitted from a motor is connected via only a friction clutch mechanism to a wiping means for wiping ink attached to a nozzle surface of a recording head, and the wiping means is rotated upward or downward by the drive force transmitted from the motor.

In this ink-jet printer, the friction clutch mechanism includes a tooth chipped gear, a normal gear, and a compression spring for pressing the gears to each other. The tooth chipped gear is formed integrally with a shaft supporting portion of the wiping means. The tooth chipped gear and the normal gear are meshed with a gear of a cam having a gear (hereinafter referred to as a "cam gear") to which the drive force is transmitted from the motor. However, a toothless portion of the tooth chipped gear and the cam gear are not meshed with each other.

In a state in which the cam gear is held in meshing engagement only with the normal gear and is not held in meshing engagement with the tooth chipped gear, the drive force from the cam gear is transmitted only to the normal gear. In this case, the drive force is not transmitted to the wiping means, so that the wiping means is not rotated. However, when the tooth chipped gear is rotated with the rotation of the normal gear by the friction clutch mechanism, the cam gear is meshed also with the tooth chipped gear. Thus, the drive force from the cam gear is transmitted also to the tooth chipped gear. As a result, the drive force is transmitted to the wiping means, so that the wiping means is rotated.

SUMMARY OF THE INVENTION

However, where the configuration in which the gear driven by the drive force transmitted from the motor is connected via only the friction clutch mechanism to a load such as the wiping means is employed for the cap lifting mechanism (that is, the cap is used as a load), there is a risk of causing the following problems.

The cap needs to be pressed to the recording head in order to form the airtight space between the recording head and the cap. Where this pressing of the cap is performed by a forcing member (i.e., a pressing member), a forcing force is generated in a direction opposite to a direction in which the forcing member presses the cap. This forcing force is generally larger than a friction force between the tooth chipped gear and the normal gear of the friction clutch mechanism. Thus, a friction clutch is idly rotated at the instant at which the cap is moved from the position at which the cap is pressed to the recording head, to the position at which the cap is distant from the recording head. That is, the tooth chipped gear is rotated independently of the normal gear. This rotation is not controlled by the motor, and thus there is a risk in which the cap is moved away from the recording head at a higher speed than assumed.

Where the cap is moved at a higher speed than assumed, there is a risk in which a meniscus of the ink formed in the ink-ejection openings of the recording head is broken, and thereby the ink drips from the ink-ejection opening. Further, there is a risk in which the ink accumulated in the cap overflows from the cap by the purging. As a result, there may be unfortunately caused an adverse effect such as spoiling of an image to be recorded on the sheet.

This invention has been developed in view of the above-described situations, and it is an object of the present invention to provide an image recording apparatus which can prevent that a speed control by a drive source cannot be performed when a cap closely contacting a recording head is moved away from the recording head, and in which the cap can be slid at an appropriate speed.

The object indicated above may be achieved according to the present invention which provides an image recording apparatus comprising: a recording head having a liquid ejecting opening and configured to eject liquid therethrough; a cap configured to be displaced to (i) a first position at which the cap covers the liquid ejecting opening by contacting the recording head and (ii) a second position which is lower than the first position and at which the cap is distant from the recording head; a slide cam having a cam face intersecting a direction in which the cap is moved and a sliding direction in which the slide cam is moved, the slide cam being configured to displace the cap by moving in the sliding direction intersecting the direction in which the cap is moved; a first pinion gear having teeth on an external circumference thereof and meshed with a drive gear to which a drive force is transmitted from a drive source; a tooth chipped gear which is disposed coaxially with the first pinion gear so as to be meshed with the drive gear, and which has teeth having the same pitch as the first pinion gear, the teeth being partly chipped so as not to be meshed with the drive gear; a first forcing member configured to force at least one of the first pinion gear and the tooth chipped gear in a thrust direction such that the first pinion gear and the tooth chipped gear are pressed to each other; a second pinion gear configured to be rotated with the tooth chipped gear; a third pinion gear having play which allows a movement of the second pinion gear in a circumferential direction thereof relative to the third pinion gear, the third pinion gear being configured to be engaged with the second pinion gear and to be meshed with the slide cam over an area thereof between a first moving end portion and a second moving end portion of the slide cam which are respectively one and the other end portions of the area meshed with the third pinion gear; a first rack gear provided on the slide cam in the direction in which the slide cam is moved and configured to be meshed with the second pinion gear; and a second rack gear provided on the slide cam at a position parallel to the first rack gear and configured to be meshed with the third pinion gear, wherein the first rack gear is configured not to be meshed with the second pinion gear when the second pinion gear faces the first moving end portion of the slide cam at which the slide cam holds the cap at the first position and not to be meshed with the second pinion gear when the second pinion gear faces the second moving end portion of the slide cam at which the slide cam holds the cap at the second position, and configured to be meshed with the second pinion gear in a state in which the slide cam supports the cap on the cam face thereof when a portion of the slide cam which faces the second pinion gear is displaced between the first moving end portion and the second moving end portion, wherein the second rack gear is configured to be meshed with the third pinion gear over the area of the slide cam between the first moving end portion and the second moving end portion, wherein the teeth of the tooth chipped gear are partly chipped such that the second pinion gear faces the area of the slide cam between the first moving end portion and the second moving end portion by the rotation of the tooth chipped gear meshed with the drive gear, and wherein the second pinion gear is configured to be rotated relative to the third pinion gear so as to be rotated due to the play at least until the tooth chipped gear is meshed with the drive gear when the second pinion gear faces the first moving end portion.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIGS. 6A, 6B. and 6C are schematic views for explaining a position of a cap 55, wherein FIG. 6A shows a state in which the cap 55 is held at a second position, FIG. 6B shows a state in which the cap 55 is moving between a first position and the second position.

FIGS. 8A to 8L are schematic views for explaining an operation of the cam mechanism 60, wherein FIG. 8A shows cross sections of the cam mechanism 60 taken along lines A-A and B-B in FIG. 7 in the state in which the cap 55 is held at the first position, FIG. 8B shows a cross section taken along a line C-C in FIG. 7 in the state in which the cap 55 is held at the first position, FIG. 8C shows a cross section of the cam mechanism 60 taken along a line D-D in the state in which the cap 55 is held at the first position, FIG. 8D shows cross sections of the cam mechanism 60 taken along the lines A-A and B-B in FIG. 7 just before the holding of the cap 55 at the first position is released, FIG. 8E shows a cross section taken along the line C-C in FIG. 7 just before the holding of the cap 55 at the first position is released, FIG. 8F shows a cross section of the cam mechanism 60 taken along the line D-D in FIG. 7 just before the holding of the cap 55 at the first position is released, FIG. 8G shows cross sections of the cam mechanism 60 taken along the lines A-A and B-B in FIG. 7 in a state in which the cap 55 is positioned between the first position and the second position, FIG. 8H shows a cross section taken along the line C-C in FIG. 7 in the state in which the cap 55 is positioned between the first position and the second position, FIG. 81 shows a cross section of the cam mechanism 60 taken along the line D-D in FIG. 7 in the state in which the cap 55 is positioned between the first position and the second position, FIG. 8J shows cross sections of the cam mechanism 60 taken along the lines A-A and B-B in FIG. 7 in the state in which the cap 55 is held at the second position, FIG. 8K shows a cross section taken along the line C-C in FIG. 7 in the state in which the cap 55 is held at the second position, and FIG. 8L shows a cross section of the cam mechanism 60 taken along the line D-D in FIG. 7 in the state in which the cap 55 is held at the second position;

FIGS. 9A and 9B are perspective views showing the cam mechanism 60 and components around the cam mechanism 60, wherein FIG. 9A shows an external view of an entirety of the cam mechanism 60, and FIG. 9B shows a third pinion gear 16, a first rack gear 17, and a second rack gear 18 of the cam mechanism 60.

DESCRIPTION OF THE EMBODIMENT

Hereinafter, there will be described an embodiment of the present invention by reference to the drawings.

<Multi-Function Apparatus 1>

Figure 1:
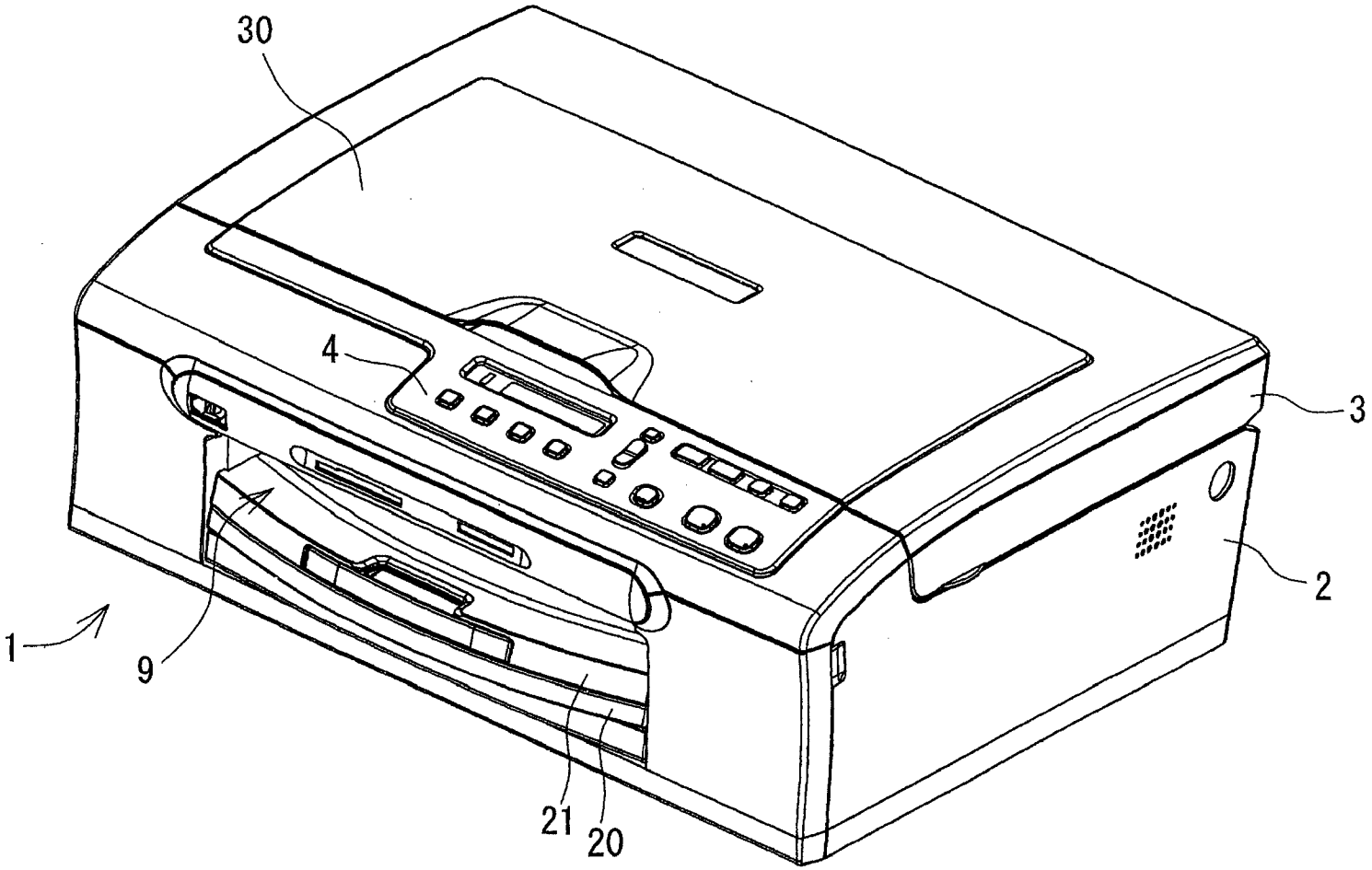
FIG. 1 is a perspective view showing an external construction of a multi-function apparatus 1.

As shown in FIG. 1, a multi-function apparatus 1 as an example of an image recording apparatus as an embodiment of the present invention is a multi-function product (MFP) integrally including a printing section 2 and a scanning section 3 and having a plurality of functions such as a printing function, a scanning function, a copying function, and a facsimile function. The printing section 2 of the multi-function apparatus 1 corresponds to an ink-jet image recording apparatus to which the present invention is applied. Thus, in this multi-function apparatus 1, the functions other than the printing function may be omitted, that is, the ink-jet image recording apparatus of the present invention may be configured, for example, as a single-function printer from which the scanning section 3 is omitted.

As shown in FIG. 1, the multi-function apparatus 1 has a generally rectangular parallelepiped shape. A lower portion of the multi-function apparatus 1 functions as the printing section 2 while an upper portion thereof functions as the scanning section 3.

The printing section 2 of the multi-function apparatus 1 is mainly connected to an external information device such as a computer. The printer section 2 records an image and/or characters on a recording medium in the form of a recording sheet on the basis of recording data including image data and/or character data transmitted from the computer or the like. An opening 9 is formed in the front side of the printing section 2. A sheet-supply tray 20 and a sheet-discharge tray 21 are superposed on each other in a vertical direction in the opening 9. In the recording, an uppermost one of the recording sheets accommodated in the sheet-supply tray 20 is supplied toward an inside of the printing section 2. The printing section 2 records a desired image on the supplied recording sheet. Then, the recorded recording sheet on which the image is recorded is discharged to the sheet-discharge tray 21.

The scanning section 3 is constituted as what is called a flat-bed scanner. A document cover 30 is provided as a top plate of the multi-function apparatus 1 so as to be openable and closable. Though not shown, a platen glass and an image sensor are provided below the document cover 30. An image of an original document placed on the platen glass is read by the image sensor. It is noted that the scanning section 3 is not necessary for realizing the present invention, and a detailed explanation of which is dispensed with.

As shown in FIG. 1, on the front side of the upper portion of the multi-function apparatus 1, there is provided an operation panel 4 for operating the printing section 2 and the scanning section 3. The operation panel 4 is constituted by various types of operation buttons, a liquid crystal display portion, and so on. The multi-function apparatus 1 is configured to be operated in accordance with operational commands from the operation panel 4. Where the multi-function apparatus 1 is connected to an external computer, the multi-function apparatus 1 is operated also in accordance with commands transmitted from the external computer via a printer driver or a scanner driver.

<Printing Section 2>

Figure 2:
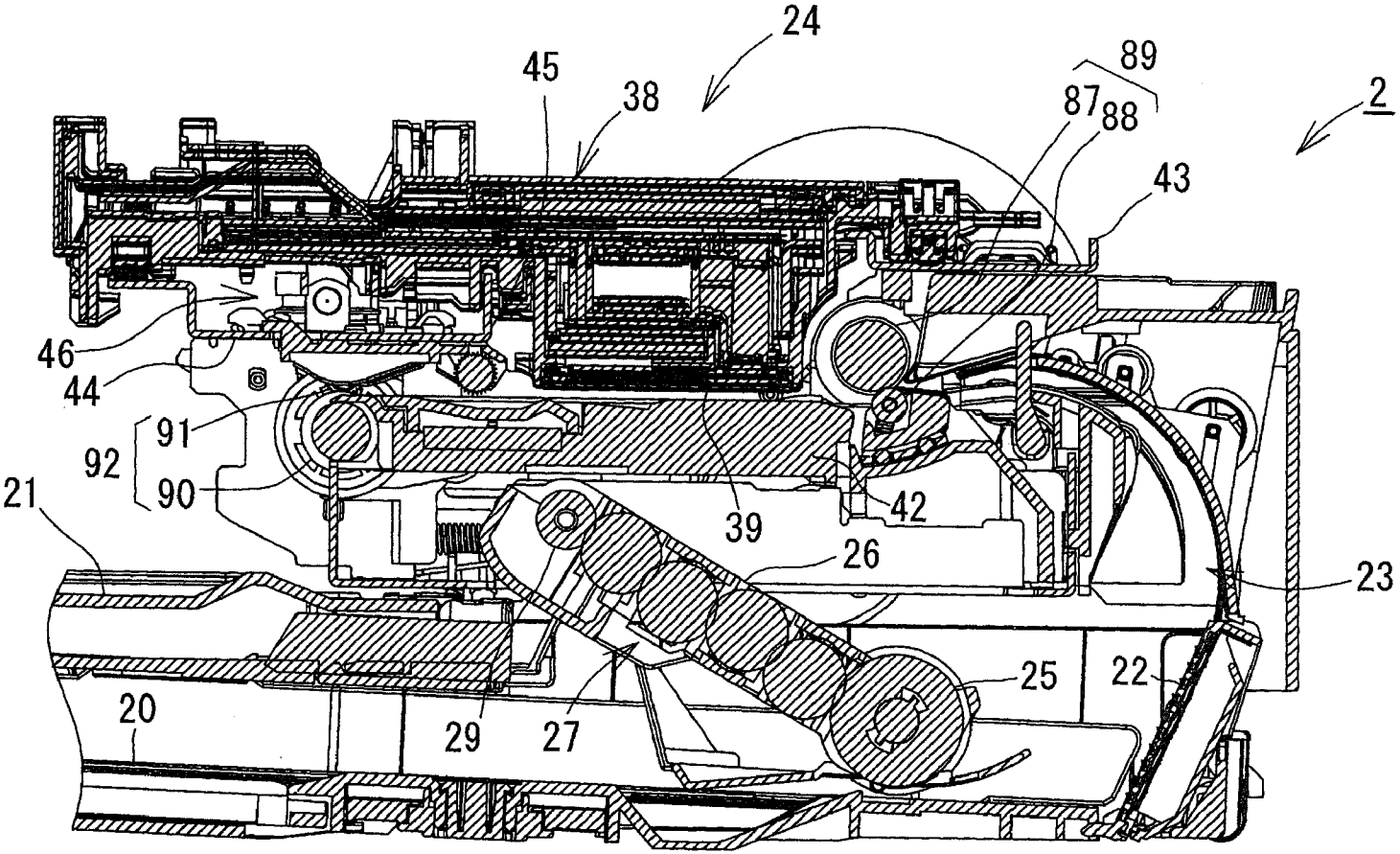
FIG. 2 is partially enlarged cross-sectional view showing a main construction of a printing section 2.

As shown in FIG. 2, the sheet-supply tray 20 is disposed at a bottom portion of the multi-function apparatus 1. A sheet-supply roller 25 is provided on an upper side of the sheet-supply tray 20. The sheet-supply roller 25 is rotatably supported by a free end of a sheet-supply arm 26, the other end of which is pivotably supported by a shaft 29. The sheet-supply roller 25 is driven so as to be rotated by a drive force of an ASF motor, not shown, via a gear train 27. The ASF motor is provided in the printing section 2. Specifically, in FIG. 3, the ASF motor is disposed on a back side of a left end portion of a platen 42.

On a rear side of the sheet-supply tray 20, an inclined plate 22 is disposed. When the sheet-supply roller 25 is rotated in a state in which the sheet-supply roller 25 is pressed onto the uppermost recording sheet on the sheet-supply tray 20, the recording sheet is fed toward the inclined plate 22 by a friction between a surface of the sheet-supply roller 25 and the recording sheet. The recording sheet is guided upward by contacting the inclined plate 22 at a leading end thereof. A sheet-feed path 23 extends from the inclined plate 22 along a path through which the recording sheet is to be fed. Specifically, the sheet-feed path 23 initially extends upward from the inclined plate 22 and then turns toward the front side of the multi-function apparatus 1. Further, the sheet-feed path 23 extends from the rear side toward the front side of the multi-function apparatus 1 while passing through a lower portion of an image recording unit 24 and finally reaches the sheet-discharge tray 21. Accordingly, the recording sheet accommodated in the sheet-supply tray 20 is fed to the image recording unit 24 while being guided through the sheet-feed path 23 so as to make an upward U-turn. After the image recording is performed by the image recording unit 24, the recording sheet is discharged to the sheet-discharge tray 21.

As shown in FIG. 2, the image recording unit 24 is disposed in the sheet-feed path 23. The image recording unit 24 includes a carriage 38 and an ink-jet recording head 39 which is mounted on the carriage 38. The carriage 38 is supported so as to be slidable in a main scanning direction perpendicular to a sheet feeding direction in which the recording sheet is fed (that is, the main scanning direction coincides with a direction perpendicular to a sheet surface of FIG. 2).

Figure 5:
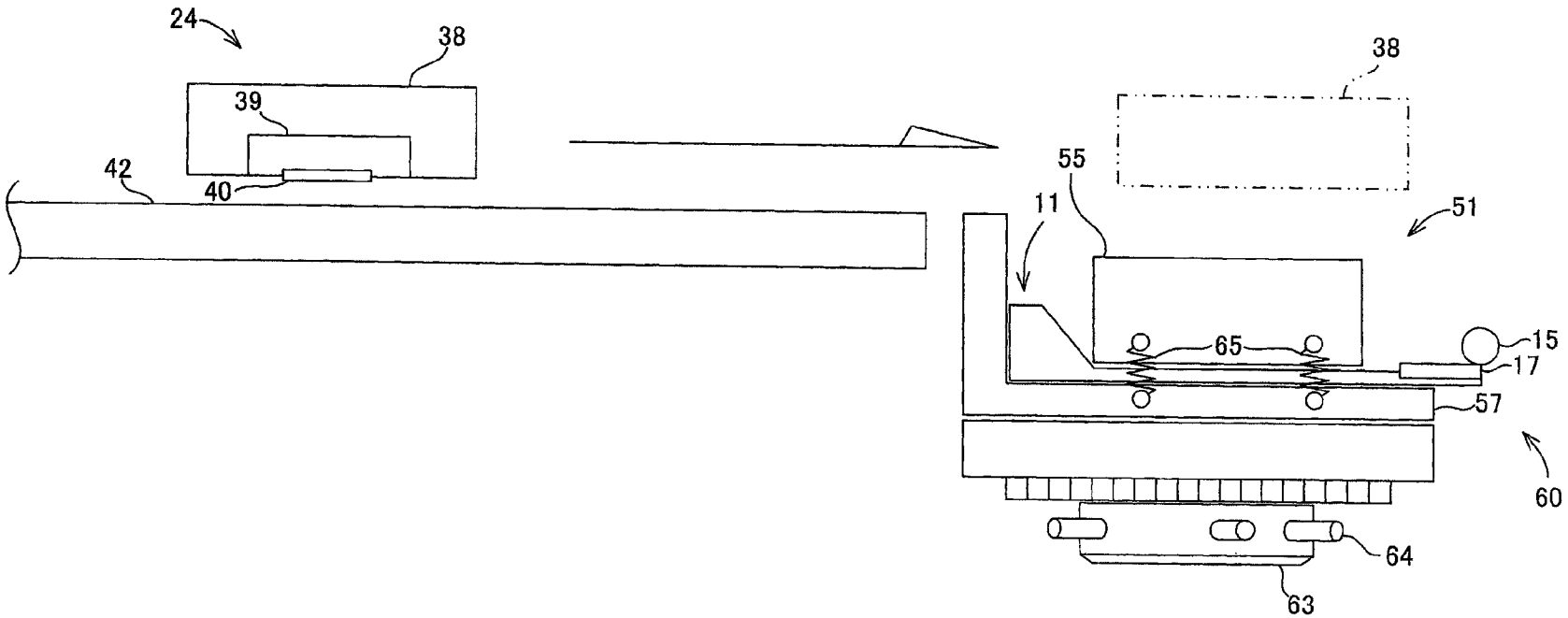
FIG. 5 is a side view schematically showing a side construction of a maintenance mechanism 51.

The recording head 39 is disposed on a bottom face of the carriage 38, and, as shown in FIG. 5, nozzles (i.e., liquid ejecting openings) 40 of the recording head 39 is exposed at a lower face of the carriage 38. Inks of respective different colors are supplied to the recording head 39 from ink cartridges, not shown, disposed in the multi-function apparatus 1. The inks of the different colors are selectively ejected as fine ink droplets from the nozzles 40 of the recording head 39 during sliding or reciprocation of the carriage 38. As a result, the image recording is performed on the recording sheet fed on the platen 42.

Figure 3:
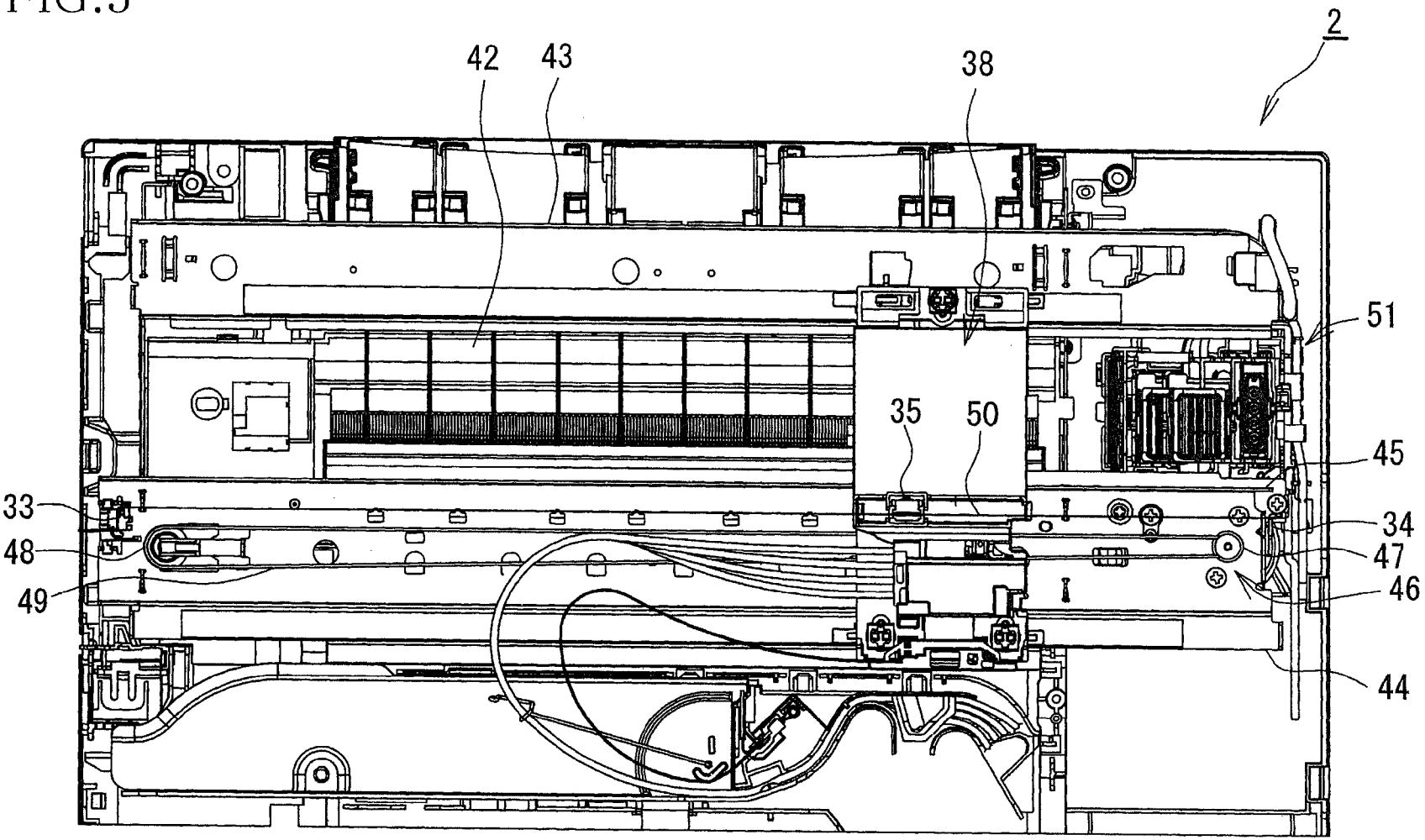
FIG. 3 is a plan view showing a main construction of the printing section 2, mainly showing a portion thereof from a generally central portion to a rear side thereof.
Figure 4:
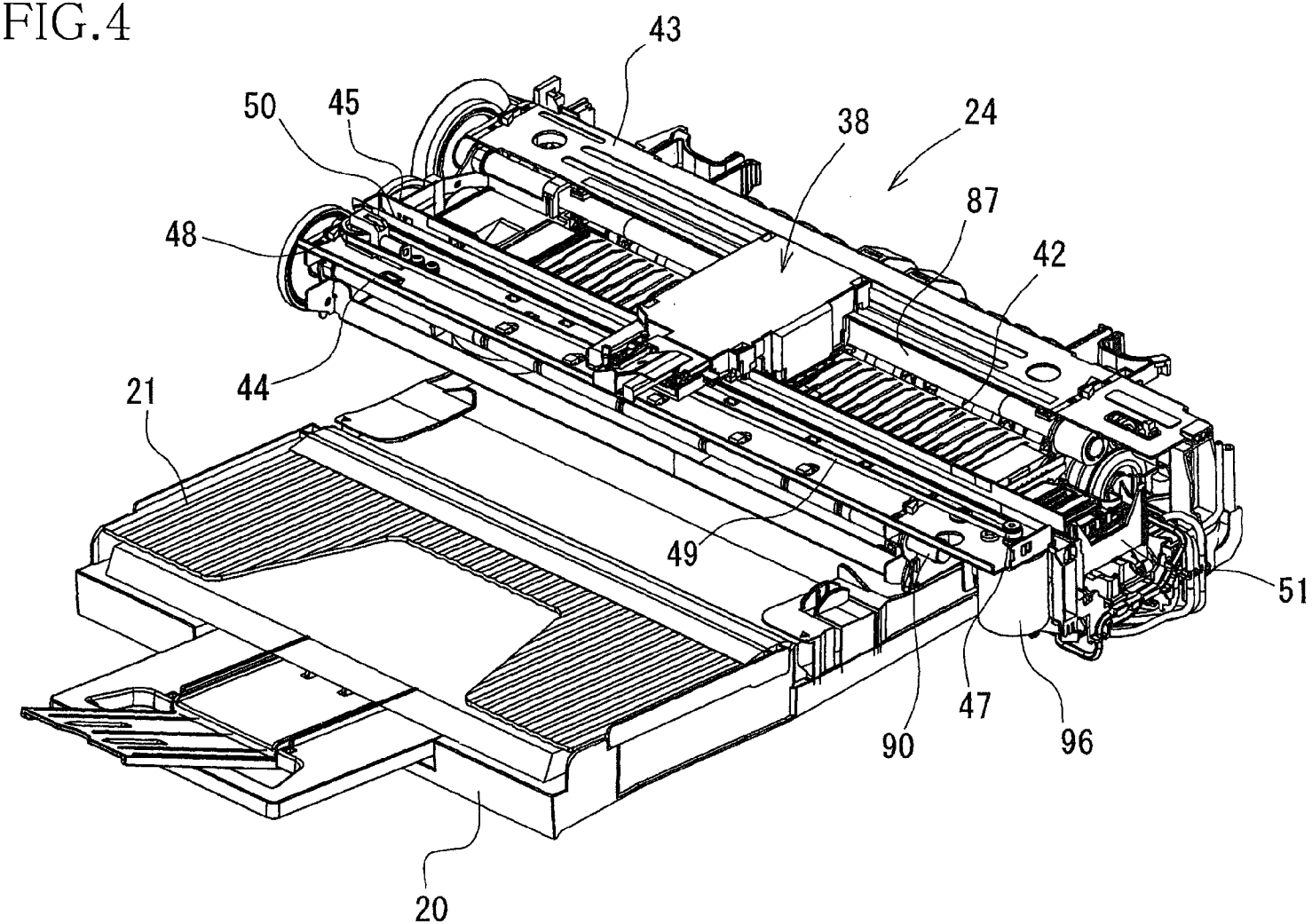
FIG. 4 is a perspective view showing a main construction of the printing section 2, mainly showing an image recording unit 24.

As shown in FIGS. 3 and 4, a pair of guide rails 43, 44 are disposed on an upper side of the sheet-feed path 23. The guide rails 43, 44 are opposed to each other with a predetermined distance being interposed therebetween in the sheet feeding direction (i.e., a direction from an upper side toward a lower side of the sheet of FIG. 3). The guide rails 43, 44 extend in the main scanning direction (i.e., a leftward and rightward direction in FIG. 3) perpendicular to the sheet feeding direction. The guide rails 43, 44 are provided in a casing of the printing section 2 and partly constitute a frame supporting components constituting the printing section 2. The carriage 38 is placed so as to bridge between the guide rails 43, 44 and is slidable in the main scanning direction.

The guide rail 43 is disposed on an upstream side of the guide rail 44 in the sheet feeding direction. The guide rail 43 has a plate shape whose length in a widthwise direction of the sheet-feed path 23 (i.e., in the leftward and rightward direction in FIG. 3) is larger than a range of the reciprocation of the carriage 38. Further, the guide rail 44 is disposed on a downstream side of the guide rail 44 in the sheet feeding direction. The guide rail 44 has a plate shape whose length in the widthwise direction of the sheet-feed path 23 is generally the same as that of the guide rail 43. An upstream end of the carriage 38 in the sheet feeding direction is placed on the guide rail 43 while a downstream end of the carriage 38 in the sheet feeding direction is placed on the guide rail 44, so that the carriage 38 is slid in a longitudinal direction of the guide rails 43, 44.

An upstream edge portion 45 of the guide rail 44 in the sheet feeding direction is bent generally at 90 degrees so as to extend upward. The carriage 38 held by the guide rails 43, 44 nips and holds the edge portion 45 by nipping members such as a pair of rollers so as to be slidable. As a result, the carriage 38 is positioned in the sheet feeding direction and slidable in a direction perpendicular to the sheet feeding direction. That is, the carriage 38 is held on the guide rails 43, 44 so as to be slidable and is configured to reciprocate in a direction perpendicular to the sheet feeding direction, with the edge portion 45 of the guide rail 44 being as a reference. It is noted that, though not shown, the edge portion 45 is coated with a lubricant such as a grease in order for a smooth sliding movement of the carriage 38.

As shown in FIG. 3, a belt driving and transmitting mechanism 46 is provided on an upper face of the guide rail 44. The belt driving and transmitting mechanism 46 includes a drive pulley 47, a driven pulley 48, and an endless belt 49.

The drive pulley 47 and the driven pulley 48 are disposed near respective opposite ends of the sheet-feed path 23 in the widthwise direction thereof. The endless belt 49 is tensioned between the drive pulley 47 and the driven pulley 48. To a shaft of the drive pulley 47 is connected a drive shaft of a CR motor 96 (with reference to FIG. 4) provided in the printing section 2. When a drive force of the CR motor 96 is transmitted to the drive pulley 47, the belt 49 is circulated by the rotation of the drive pulley 47. It is noted that a belt having opposite ends which are to be fixed to the carriage 38 may be employed instead of the endless belt 49.

The carriage 38 is connected at a bottom face thereof to the belt 49. Thus, the carriage 38 is slid on the guide rails 43, 44 on the basis of the circulation of the belt 49 with the edge portion 45 being as the reference. That is, the carriage 38 is slid with the CR motor 96 (with reference to FIG. 4) being as a drive source. The recording head 39 is mounted on the carriage 38 thus explained, so that the recording head 39 is reciprocated in the widthwise direction of the sheet-feed path 23 as the main scanning direction, accompanying with the reciprocation of the carriage 38.

As shown in FIG. 3, an encoder strip 50 is disposed on the guide rail 44. The encoder strip 50 has a shape like a band and is formed of a transparent resin. A pair of support ribs 33, 34 are formed respectively at opposite ends of the guide rail 44 in a widthwise direction thereof (i.e., a direction in which the carriage 38 is slid) so as to stand upright on the upper face of the guide rail 44. The encoder strip 50 is engaged at opposite end portions thereof respectively with the support ribs 33, 34 so as to extend along the edge portion 45. It is noted that tension is applied to the encoder strip 50 by, e.g., a spring.

The encoder strip 50 includes light transmitting portions each of which transmits light and light intercepting portions each of which intercepts light. The light transmitting portions and the light intercepting portions are alternately arranged at predetermined pitches in a longitudinal direction of the encoder strip 50 so as to form a predetermined pattern. An optical sensor 35 of a transmission type is provided on an upper face of the carriage 38. The optical sensor 35 is provided at a position corresponding to the encoder strip 50. The encoder strip 50 and the optical sensor 35 constitute a linear encoder for detecting a position of the carriage 38. A controller, not shown, of the multi-function apparatus 1 can detect the position of the carriage 38 on the basis of a detection signal from the optical sensor 35. The controller controls components such as the CR motor 96 and the ASF motor on the basis of the detected positional information.

As shown in FIGS. 2 and 3, the platen 42 is provided on a lower side of the sheet-feed path 23 so as to face the recording head 39. The platen 42 extends over a central portion of the reciprocation range of the carriage 38, through which the recording sheet passes. A width of the platen 42 is made sufficiently larger than the largest one of respective widths of various types of feedable recording sheets. Opposite ends of the recording sheet in the widthwise direction thereof always pass on the platen 42.

As shown in FIGS. 3 and 4, a maintenance mechanism 51 is provided on a portion of the printing section 2 through which the recording sheet does not pass, that is, on an outside of an image recording area in which the image recording is performed by the recording head 39. Specifically, the maintenance mechanism 51 is disposed on a right end portion of the platen 42 in FIG. 3. The maintenance mechanism 51 is for preventing drying of the ink in the nozzles 40 (with reference to FIG. 5) of the recording head 39 and for removing air bubbles and foreign materials from the nozzles 40 by sucking. In the present embodiment, where the image recording is not performed, the carriage 38 is disposed above the maintenance mechanism 51. That is, the carriage 38 waits above the maintenance mechanism 51 until receiving a command for the image recording. It is noted that a detailed explanation of the maintenance mechanism 51 will be given below.

As shown in FIGS. 2 and 4, on an upstream side of the image recording unit 24 in the sheet feeding direction, there are provided a pair of feed rollers 89 constituted by a sheet-feed roller 87 and a pinch roller 88. On a downstream side of the image recording unit 24 in the sheet feeding direction, there are provided a pair of sheet-discharge rollers 92 constituted by a sheet-discharge roller 90 and a spur roller 91 disposed on an upper side of the sheet-discharge roller 90. One end of the sheet-feed roller 87 in an axial direction thereof is connected to the ASF motor via gears. When the drive force of the ASF motor is transmitted to the sheet-feed roller 87, the sheet-feed roller 87 is intermittently driven at a suitable line feed pitch. It is noted that the sheet-feed roller 87 may be driven by a drive force from another motor, not shown, different from the ASF motor.

The sheet-feed roller 87 and the sheet-discharge roller 90 are connected to each other by a transmitting mechanism such as a gear. The drive force is transmitted from the sheet-feed roller 87 to the sheet-discharge roller 90 via the transmitting mechanism. The recording sheet being fed through the sheet-feed path 23 is fed onto the platen 42 by the pair of feed rollers 89. Then, the recorded recording sheet which has been subjected to the image recording on the platen 42 is fed to the sheet-discharge tray 21 by the pair of sheet-discharge rollers 92.

<Maintenance Mechanism 51>

As shown in FIGS. 3 and 5, the maintenance mechanism 51 is provided on an outside of the image recording area in which the image recording is performed by the recording head 39. The maintenance mechanism 51 includes a cap 55, a first frame 57, an ink-discharge portion 63, a cam mechanism 60, and so on.

Figure 6A:
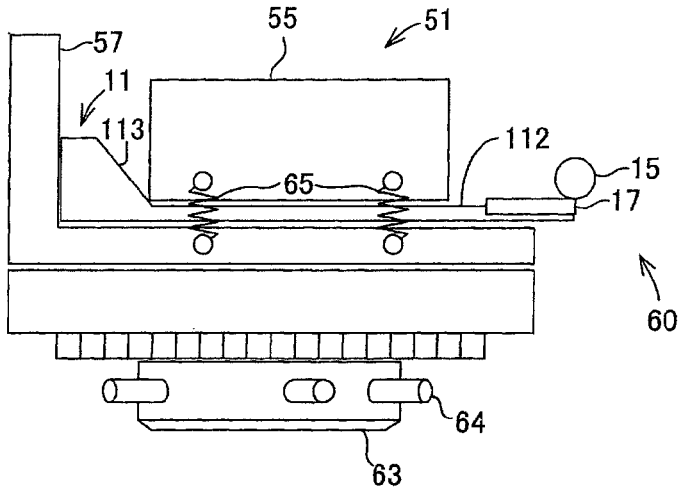

The cap 55 is for covering the nozzles 40 of the recording head 39 when the carriage 38 is moved to a capping position set at a position directly above the maintenance mechanism 51 and indicated by a two-dot chain line in FIG. 5. In the present embodiment, the cap 55 is elastically supported in an upward and downward direction by a coil spring 65 as a second forcing member provided between a lower portion of the cap 55 and a bottom face of the first frame 57.

Where a length of the coil spring 65 in the upward and downward direction is an original length, that is, where an external force is not applied to the cap 55, the cap 55 is disposed at a position as a second position at which the cap is distant from the recording head 39 with reference to FIGS. 5 and 6A. When the cap 55 is pushed upward by a slide cam 11 which will be described below, the coil spring 65 is extended. In this time, the coil spring 65 forces or biases the cap 55 downward by generating a spring force in a direction in which the coil spring 65 is contracted. The cap 55 is pushed upward by the slide cam 11, thereby being moved from the second position to a first position (with reference to FIG. 6C) which is higher than the second position and at which the cap 55 covers the nozzles 40 by pressing the recording head 39. It is noted that the positional change of the cap 55 will be explained in greater detail below.

The ink-discharge portion 63 is mounted on a lower portion of the first frame 57. The ink-discharge portion 63 includes tube joints 64. The tube joints 64 are connected to the cap 55. To each of the tube joints 64 is connected one end of a tube, not shown, while the other end of the tube is connected to a pump, not shown. When the pump is driven in the state in which the cap 55 is disposed at the first position, that is, in the state in which the cap 55 covers the nozzles 40, the ink in the nozzles 40 is forcefully sucked by the pump to be discharged to a waste ink tray, not shown. This operation is referred to as a purging operation.

<Cam Mechanism 60>

Figure 7:
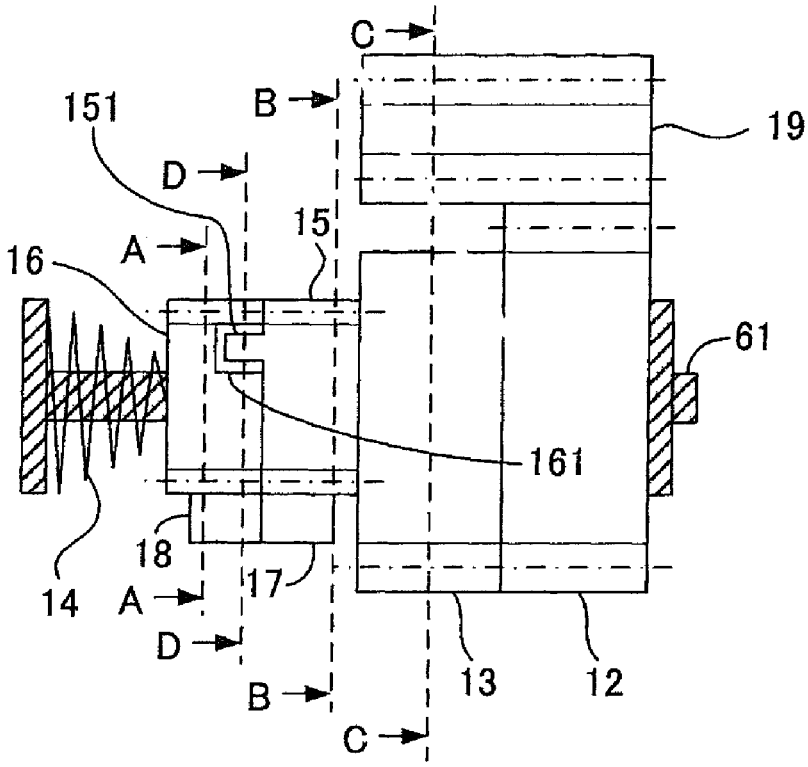
FIG. 7 is a schematic view showing an arrangement of gears of a cam mechanism 60.
Figure 8A:
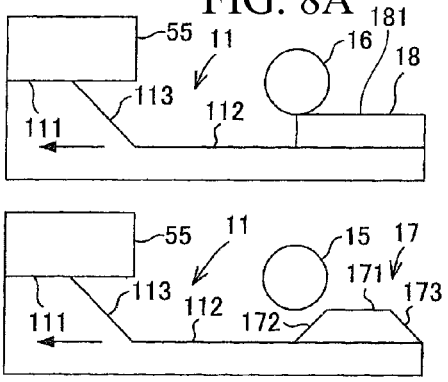

There will be hereinafter explained the cam mechanism 60 with reference to FIGS. 5 to 9B. Here, FIG. 7 is a cross-sectional view of the cam mechanism 60 when seen from a right side to a left side of a sheet of FIGS. 6A, 6B, and 6C. An upper figure of each of FIGS. 8A, 8D, 8Q and 8J is a cross-sectional view of the cam mechanism 60 taken along line A-A of FIG. 7. A lower figure of each of FIGS. 8A, 8D, 8Q and 8J is a cross-sectional view of the cam mechanism 60 taken along line B-B of FIG. 7. FIGS. 8B, 8E, 8H, and 8K are cross-sectional views taken along line C-C of FIG. 7. FIGS. 8C, 8F, 8I, and 8L are cross-sectional views taken along line D-D of FIG. 7. FIG. 9A is a perspective view showing the cam mechanism 60 and components around the cam mechanism 60. FIG. 9B is a perspective view showing the cam mechanism 60 and components around the cam mechanism 60 in the case where components other than a third pinion gear 16, a first rack gear 17, and a second rack gear 18 are omitted.

As shown in FIGS. 5, 6A, 6B, 6C, 9A, and 9B, the cam mechanism 60 is provided on a lower side of the cap 55. As shown in FIGS. 5 to 9B, the cam mechanism 60 includes the slide cam 11, a first pinion gear 12, a tooth chipped gear 13, a coil spring 14 as a first forcing member, a second pinion gear 15, the third pinion gear 16, the first rack gear 17, and the second rack gear 18.

The slide cam 11 is supported so as to be slidable in a direction coinciding with the direction in which the carriage 38 reciprocates or slides. The slide cam 11 has a guide face which contacts a lower face of the cap 55. As shown in FIGS. 8A, 8D, 8Q and 8J, the guide face is constituted by three faces respectively located at different heights, namely, (a) a first guide face 111 as a first cam face located at a high position, (b) a second guide face 112 as a second cam face located at a low position, and (c) an inclined face 113 as a cam face continued to the first guide face 111 and the second guide face 112 so as to connect the first guide face 111 and the second guide face 112. The inclined face 113 is not parallel to the direction as a sliding direction in which the slide cam 11 is moved and is not parallel to the direction in which the cap 55 is moved.

As shown in FIG. 6A, only the second guide face 112 is entered into and positioned in a space between the lower face of the cap 55 and an upper face of the first frame 57. Where the second guide face 112 and the lower face of the cap 55 are held in contact with each other, the cap 55 is held at the second position.

Figure 6B:
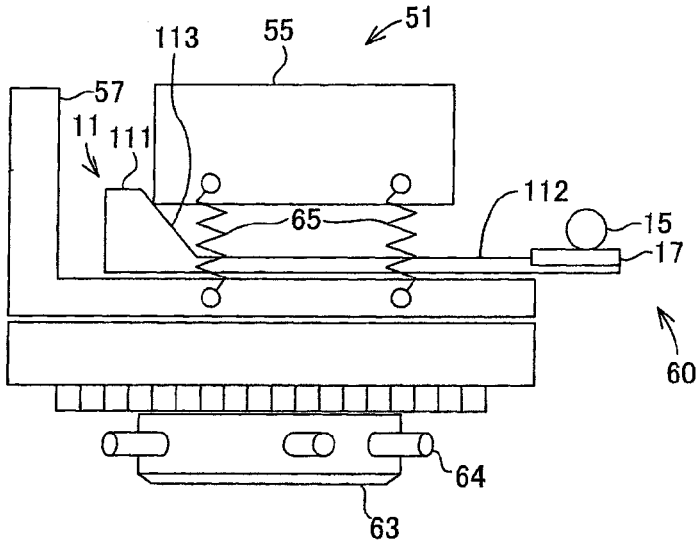

When the slide cam 11 is slid toward a right side of a sheet of each of FIG. 5 and FIGS. 6A, 6B, and 6C by receiving a drive force transmitted from a drive source (the ASF motor in the present embodiment as will be described below), as shown in FIG. 6B, the inclined face 113 is entered into and positioned in the space between the lower face of the cap 55 and the upper face of the first frame 57 in addition to the second guide face 112. As a result, the second guide face 112 is separated from the lower face of the cap 55, and the inclined face 113 is brought into contact with the lower face of the cap 55. As a result, the cap 55 is moved from the second position toward the first position in accordance with the height of the inclined face 113.

Figure 6C:
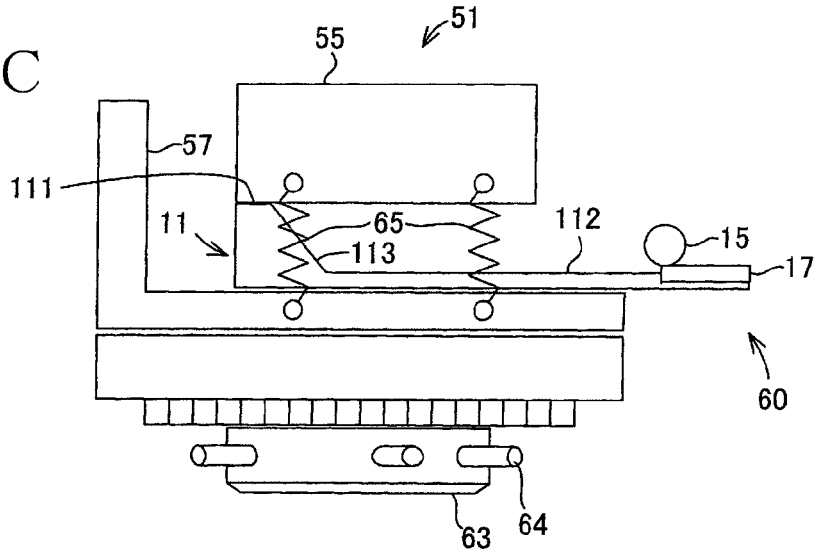
FIG. 6C shows a state in which the cap 55 is held at the first position.

When the slide cam 11 is slid toward the right side of the sheet of each of FIGS. 5, 6A, 6B, and 6C by receiving the drive force transmitted from the drive source, as shown in FIG. 6C, the first guide face 111 is entered into and positioned in the space between the lower face of the cap 55 and the upper face of the first frame 57 in addition to the second guide face 112 and the inclined face 113. As a result, the inclined face 113 is separated from the lower face of the cap 55, and the first guide face 111 is brought into contact with the lower face of the cap 55. As a result, the cap 55 is held at the first position.

The first pinion gear 12 having teeth on an entire external circumference face thereof is rotated by receiving the drive force transmitted from the ASF motor via a drive force transmitting mechanism. The drive force transmitting mechanism is constituted by an intermediate gear or gears constituted by, e.g., at least one planetary gear. The drive force of the ASF motor is transmitted to the first pinion gear 12 via the intermediate gear or gears. The intermediate gear or gears constituting the drive force transmitting mechanism include an intermediate gear 19 (with reference to FIG. 7) as a drive gear which is meshed with the first pinion gear 12. It is noted that, in the present embodiment, the ASF motor is used as the drive source, but another motor may be used as the drive source.

As shown in FIG. 7, the tooth chipped gear 13 having teeth having the same pitch as the first pinion gear 12 is supported by a support shaft 61 with the first pinion gear 12. Like the first pinion gear 12, the tooth chipped gear 13 is rotated by the drive force transmitted from the ASF motor. Further, the coil spring 14 is provided along the support shaft 61. Specifically, the support shaft 61 extends through a center of the coil spring 14. The coil spring 14 forces the tooth chipped gear 13 rightward in FIG. 7, that is, the coil spring 14 forces the tooth chipped gear 13 in a direction in which the coil spring 14 presses the first pinion gear 12. As a result, the tooth chipped gear 13 is rotatable, in addition to by the drive force transmitted from the ASF motor, by a friction between the tooth chipped gear 13 and the first pinion gear 12 when the first pinion gear 12 is rotated.

Figure 8B:
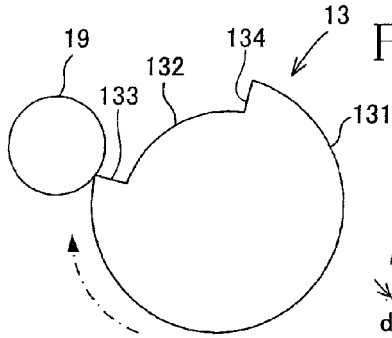
Figure 8C:
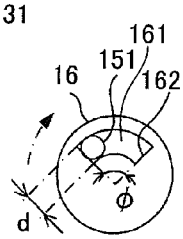

As shown in FIG. 8B, teeth formed on a peripheral surface of the tooth chipped gear 13 are chipped over a specific range. That is, the tooth chipped gear 13 includes (a) a toothed portion 131 having teeth and (b) a toothless portion 132 having no teeth. The toothed portion 131 has a first toothed end portion 133 and a second toothed end portion 134. The first toothed end portion 133 is one of end portions of the toothed portion 131 in a circumferential direction of the tooth chipped gear 13 and is meshed with the intermediate gear 19 when the cap 55 is located at the first position. The second toothed end portion 134 is the other of the end portions of the toothed portion 131 in the circumferential direction of the tooth chipped gear 13 and is meshed with the intermediate gear 19 when the cap 55 is located at the second position. The toothed portion 131 is configured such that the teeth are formed over an area of the toothed portion 131 from the first toothed end portion 133 to the second toothed end portion 134 in the circumferential direction of the tooth chipped gear 13. Where the cap 55 is positioned between the first position and the second position (with reference to FIG. 8G), the toothed portion 131 faces the intermediate gear 19 (with reference to FIG. 8H). In this time, since the tooth chipped gear 13 and the intermediate gear 19 are meshed with each other, the drive force is transmitted from the intermediate gear 19 to the tooth chipped gear 13, thereby rotating the tooth chipped gear 13. The drive force is transmitted from the intermediate gear 19 to the tooth chipped gear 13, so that the tooth chipped gear 13 is rotated. As a result, when the intermediate gear 19 faces the first toothed end portion 133, the cap 55 is positioned at the first position. Further, when the tooth chipped gear 13 is rotated, the intermediate gear 19 faces the toothless portion 132 (with reference to FIG. 8B). In this state, the tooth chipped gear 13 is not meshed with the intermediate gear 19, so that the drive force is not directly transmitted from the intermediate gear 19 to the tooth chipped gear 13. Further, when the intermediate gear 19 is held in meshing engagement with the second toothed end portion 134, the cap 55 is located at the second position. When the tooth chipped gear 13 is further rotated, the intermediate gear 19 faces the toothless portion 132 (with reference to FIG. 8K). In this state, the tooth chipped gear 13 is not meshed with the intermediate gear 19, so that the drive force is not directly transmitted from the intermediate gear 19 to the tooth chipped gear 13. Thus, when the intermediate gear 19 faces the toothless portion 132 of the tooth chipped gear 13 as shown in FIGS. 8B and 8K, the tooth chipped gear 13 is not rotated by the drive force directly transmitted from the intermediate gear 19.

As shown in FIG. 7, the second pinion gear 15 is supported by the support shaft 61 with the first pinion gear 12 and the tooth chipped gear 13. The second pinion gear 15 is fixed to the tooth chipped gear 13 at one of faces of the second pinion gear 15 in a thrust direction (i.e., an axial direction of the support shaft 61) in which the coil spring 14 presses or thrusts the gears, that is, in a rightward and leftward direction in FIG. 7, so that the second pinion gear 15 is rotated integrally with the tooth chipped gear 13. The second pinion gear 15 has a projecting portion 151 provided on the other of the faces of the second pinion gear 15 which is opposite to the one face thereof fixed to the tooth chipped gear 13. The projecting portion 151 is fitted in or engaged with a recessed portion 161 of the third pinion gear 16 which will be explained below, thereby being slid along the recessed portion 161.

As shown in FIG. 7, the third pinion gear 16 is supported by the support shaft 61 with the first pinion gear 12, the tooth chipped gear 13, and the second pinion gear 15. The third pinion gear 16 has the recessed portion 161 formed in one of faces of the third pinion gear 16 in the thrust direction, the one face being held in contact with the second pinion gear 15. As shown in FIG. 8C, the recessed portion 161 has a predetermined width d in a radial direction of the tooth chipped gear 13, over a predetermined angle $\phi$ in a circumferential direction thereof. The predetermined width d of the recessed portion 161 is larger than a width of the projecting portion 151, so that play or space is provided in the recessed portion 161.

In the case where the second pinion gear 15 is rotated in a direction in which the projecting portion 151 presses a right end or a circumferential end part 162 of the recessed portion 161 in the circumferential direction where the projecting portion 151 is held in contact with the circumferential end part 162 of the recessed portion 161, the third pinion gear 16 is rotated integrally with the second pinion gear 15. On the other hand, where the projecting portion 151 is not held in contact with the circumferential end part 162 of the recessed portion 161 in the circumferential direction or where the second pinion gear 15 is rotated in a direction opposite to the direction in which the projecting portion 151 presses the circumferential end part 162 of the recessed portion 161 even though the projecting portion 151 is held in contact with the circumferential end part 162 of the recessed portion 161, the projecting portion 151 and the recessed portion 161 are moved relative to each other upon the rotation of the second pinion gear 15, so that the third pinion gear 16 is not rotated. That is, the third pinion gear 16 is engaged with the second pinion gear 15 and has the play in the circumferential direction.

As shown in FIGS. 7 to 9B, the first rack gear 17 is provided on the second guide face 112 of the slide cam 11 in the direction in which the slide cam 11 is moved. The first rack gear 17 is meshable with the second pinion gear 15.

The first rack gear 17 includes a toothed portion 171 having teeth formed thereon over a predetermined area in the direction in which the slide cam 11 is moved. On a portion of the slide cam 11 or the first rack gear 17 which is nearer to the inclined face 113 than the toothed portion 171 is formed no teeth so as to provide a first toothless portion 172. On a portion of the slide cam 11 or the first rack gear 17 which is further from the inclined face 113 than the toothed portion 171 is formed no teeth so as to provide a second toothless portion 173. The toothed portion 171 of the first rack gear 17 is meshable with the second pinion gear 15. On the other hand, where a portion of the slide cam 11 which faces the second pinion gear 15 when the second pinion gear 15 faces the first toothless portion 172 (with reference to FIG. 8A) is defined as a first moving end portion, the second pinion gear 15 faces the first toothless portion 172 when the second pinion gear 15 faces the first moving end portion, so that the second pinion gear 15 is not held in meshing engagement with the first rack gear 17. Further, where a portion of the slide cam 11 which faces the second pinion gear 15 when the second pinion gear 15 faces the second toothless portion 173 (with reference to FIG. 8J) is defined as a second moving end portion, the second pinion gear 15 faces the second toothless portion 173 when the slide cam 11 faces the second moving end portion, so that the second pinion gear 15 is not held in meshing engagement with the first rack gear 17.

Where the cap 55 is positioned at the first position (with reference to FIGS. 6C and 8A), the first toothless portion 172 and the second pinion gear 15 face each other. In this case, the first rack gear 17 and the second pinion gear 15 are not meshed with each other, so that the slide cam 11 is not moved by the drive force transmitted from the second pinion gear 15.

Where the cap 55 is positioned at the second position (with reference to FIGS. 6A and 8J), the second toothless portion 173 and the second pinion gear 15 face with each other. In this case, the first rack gear 17 and the second pinion gear 15 are not meshed with each other, so that the slide cam 11 is not moved by the drive force transmitted from the second pinion gear 15.

Where the cap 55 is positioned between the first position and the second position (with reference to FIGS. 6B and 8G), the toothed portion 171 and the second pinion gear 15 face each other. In this case, the first rack gear 17 and the second pinion gear 15 are meshed with each other, so that when the drive force is transmitted to the second pinion gear 15, the slide cam 11 is moved by the drive force transmitted from the second pinion gear 15. Further, also in the case where the cap 55 is supported on the first guide face 111 at a predetermined area near the inclined face 113 (with reference to FIG. 8D), the toothed portion 171 and the second pinion gear 15 face with each other. Also in this case, the first rack gear 17 and the second pinion gear 15 are meshed with each other, so that when the drive force is transmitted to the second pinion gear 15, the slide cam 11 is moved by the drive force transmitted from the second pinion gear 15.

As shown in FIGS. 7 to 9B, the second rack gear 18 is provided on the second guide face 112 of the slide cam 11 in parallel with the first rack gear 17 in the direction in which the slide cam 11 is moved. The second rack gear 18 is meshable with the third pinion gear 16.

The second rack gear 18 includes a toothed portion 181 having teeth formed thereon over a predetermined area in the direction in which the slide cam 11 is moved. The toothed portion 181 is configured such that the teeth are formed over an area of the slide cam 11 from the first moving end portion to the second moving end portion. That is, even in any of the case where the cap 55 is located at the first position, the case where the cap is located at the second position, and the case where the cap is located between the first position and the second position, the toothed portion 181 of the second rack gear 18 is meshed with the third pinion gear 16. Thus, where the drive force is transmitted to the third pinion gear 16, the slide cam 11 is moved by the drive force transmitted from the third pinion gear 16.

<Operation of Cam Mechanism 60>

There will be explained the movement of the cam mechanism 60 and the positional change of the cap 55 with reference to FIGS. 8A to 8L.

As shown in FIGS. 8A to 8C, where the cap 55 is held at the first position by the first guide face 111 of the slide cam 11, the cam mechanism 60 is in the following state. Since the toothless portion 132 of tooth chipped gear 13 faces the intermediate gear 19, the tooth chipped gear 13 is not meshed with the intermediate gear 19 (with reference to FIG. 8B). The second pinion gear 15 faces the first toothless portion 172 of the first rack gear 17 (with reference to FIG. 8A). The projecting portion 151 of the second pinion gear 15 is held in contact with a left end of the recessed portion 161 of the third pinion gear 16 (with reference to FIG. 8C).

As shown in FIG. 7, when the drive force transmitted from the ASF motor is transmitted to the first pinion gear 12 via the intermediate gear 19, and the first pinion gear 12 is rotated in a direction indicated by one-dot chain line arrow in FIG. 8B, the cam mechanism 60 takes a state explained below. Since the tooth chipped gear 13 is forced by the coil spring 14 in a direction in which the coil spring presses the first pinion gear 12, the tooth chipped gear 13 is rotated with the rotation of the first pinion gear 12 in a direction coinciding with a direction in which the first pinion gear 12 is rotated, that is, the tooth chipped gear 13 is rotated in a direction indicated by one-dot chain line arrow in FIG. 8B. As a result, the tooth chipped gear 13 and the intermediate gear 19 are meshed with each other, and the drive force is directly transmitted from the intermediate gear 19 also to the tooth chipped gear 13 (with reference to FIG. 8E).

The second pinion gear 15 is rotated integrally with the tooth chipped gear 13 by the rotation of the tooth chipped gear 13. However, as shown in FIG. 8A, the second pinion gear 15 faces the first toothless portion 172 of the first rack gear 17 and is not held in meshing engagement with the first rack gear 17. Thus, even where the second pinion gear 15 is rotated, the slide cam 11 is not moved.

A direction in which the second pinion gear 15 is rotated coincides with a direction in which the tooth chipped gear 13 is rotated, that is, the direction in which the second pinion gear 15 is rotated coincides with a direction indicated by one-dot chain line arrow in FIG. 8C. Thus, the second pinion gear 15 is moved relative to the third pinion gear 16, but the third pinion gear 16 is not rotated. Specifically, the projecting portion 151 of the second pinion gear 15 is moved toward the circumferential end part 162 of the recessed portion 161 of the third pinion gear 16. When the projecting portion 151 of the second pinion gear 15 has reached or is brought into contact with the circumferential end part 162 of the recessed portion 161 of the third pinion gear 16 (with reference to FIG. 8F), the third pinion gear 16 is rotated integrally with the second pinion gear 15. Since the third pinion gear 16 is held in meshing engagement with the second rack gear 18, the slide cam 11 begins moving in a direction indicated by solid line arrow in FIG. 8A. That is, the recessed portion 161 is configured to guide the projecting portion 151 movably in the circumferential direction such that the tooth chipped gear 13 is rotated at least until the tooth chipped gear 13 is meshed with the intermediate gear 19 when the second pinion gear 15 faces the first moving end portion.

Figure 8D:
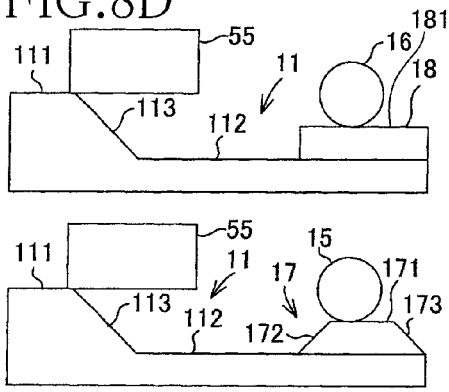
Figure 8E:
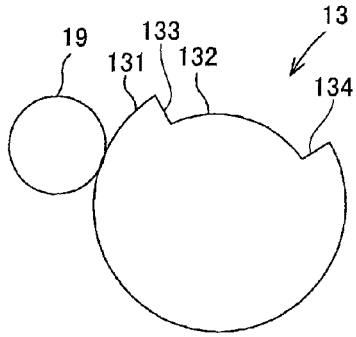
Figure 8F:
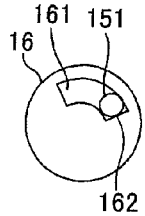

As shown in FIG. 8D, when the slide cam 11 has been moved by a predetermined amount, the state of the second pinion gear 15 is changed from the state in which the second pinion gear 15 faces the first toothless portion 172 of the first rack gear 17 to the state in which the second pinion gear 15 faces the toothed portion 171 of the first rack gear 17. As a result, the first rack gear 17 and the second pinion gear 15 are meshed with each other. Then, when the slide cam 11 is further moved by a predetermined amount, the state of the cap 55 is changed from the state in which the cap 55 is supported on the first guide face 111 to the state in which the cap 55 is supported on the inclined face 113. That is, before the state of the cap 55 is changed from the state in which the cap 55 is supported on the first guide face 111 to the state in which the cap 55 is supported on the inclined face 113, the second pinion gear 15 and the first rack gear 17 are meshed with each other. The cam mechanism 60 is constructed so as to satisfy this condition. Specifically, the cam mechanism 60 is constructed such that a length of the first toothless portion 172 is smaller than a distance (i.e., an amount) of the movement of the slide cam 11 which is required for the change of the state of the cam 55 from the state in which the cam 55 is supported on the first guide face 111 to the state in which the cam is supported on the inclined face 113.

Figure 8G:
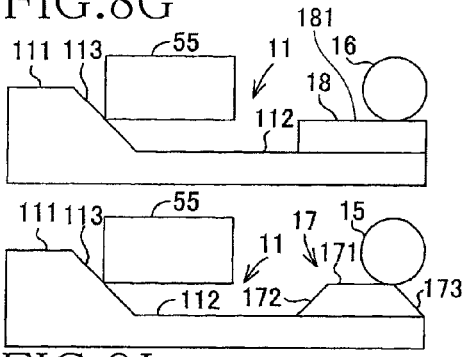
Figure 8H:
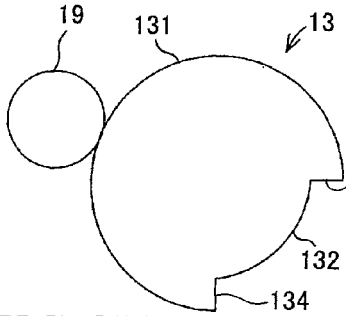
Figure 8I:
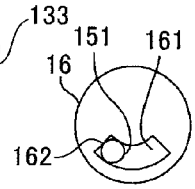
Figure 8J:
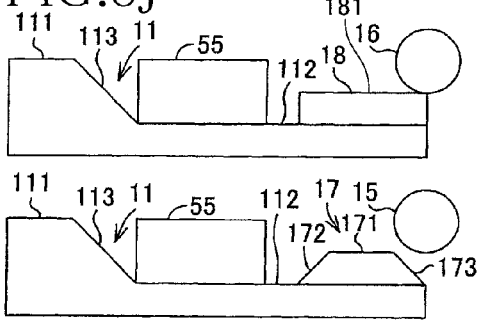
Figure 8K:
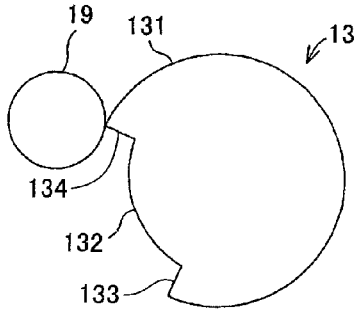
Figure 8L:
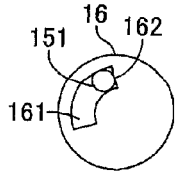
Figure 9B:
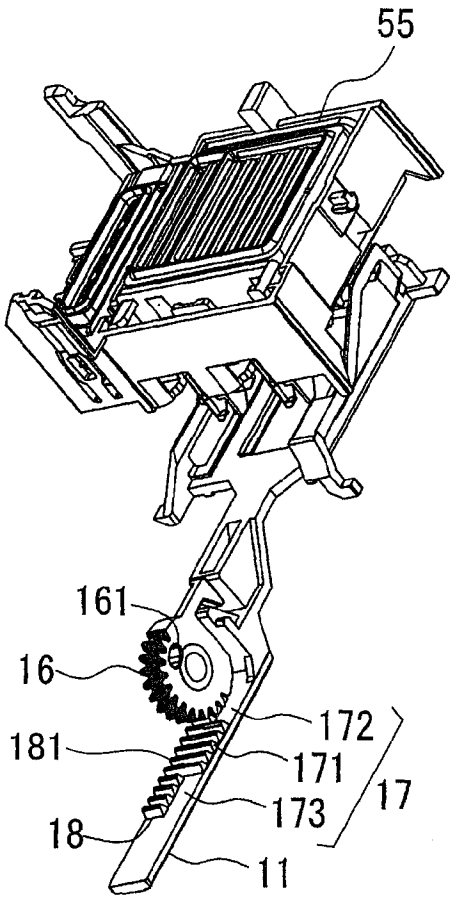
Figure 9A:
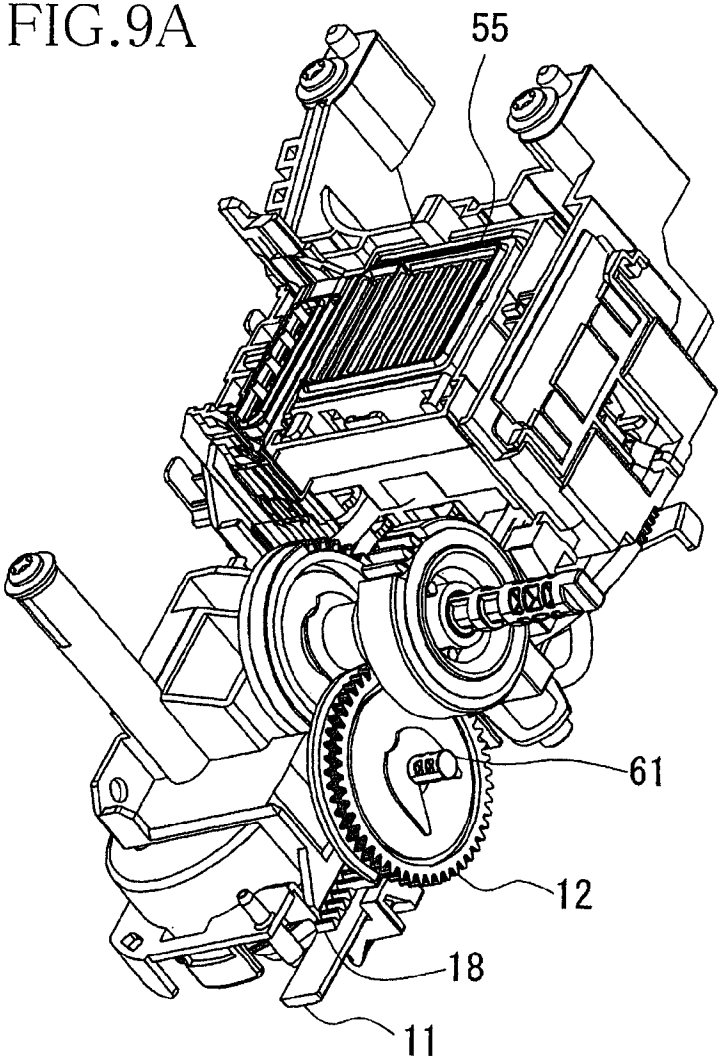

After the second pinion gear 15 and the first rack gear 17 have been meshed with each other, the state of the cap 55 is changed to the state in which the cap 55 is supported on the inclined face 113 of the slide cam 11 (with reference to FIGS. 8G-8I). The slide cam 11 continues to be moved so as to lower the cap 55 from the first position to the second position, until the tooth chipped gear 13 and the intermediate gear 19 are disengaged from each other by the facing of the toothless portion 132 of tooth chipped gear 13 and the intermediate gear 19. When the tooth chipped gear 13 and the intermediate gear 19 are disengaged from each other (with reference to FIG. 8K), that is, the cap 55 has reached the second position, the slide cam 11 is stopped (with reference to FIG. 8J). This state of the second pinion gear 15 is shown in FIG. 8L. It is noted that a positional change of the cap 55 from the second position to the first position is performed in the same procedure as the procedure in which the position of the cap 55 is changed from the first position to the second position, except that each gear is rotated in a direction reverse to the above-described direction.

<Effects of Embodiment>

In the above-described construction, where, as shown in FIG. 8A, the first toothless portion 172 of the first rack gear 17 faces the second pinion gear 15, that is, the first rack gear 17 and the second pinion gear 15 are not held in meshing engagement with each other, as shown in FIG. 8B, the tooth chipped gear 13 is not meshed with the intermediate gear 19. That is, when the toothless portion 132 faces the intermediate gear 19 as a result of rotation of the tooth chipped gear 13 in a direction (hereinafter may be referred to as a "first direction") reverse to the direction indicated by the one-dot chain line arrow in FIG. 8B, the meshing engagement of the tooth chipped gear 132 and the intermediate gear 19 is released. In this case, the tooth chipped gear 132 is not rotated any more in the first direction.

In this state, in order to rotate the tooth chipped gear 13 in the direction indicated by the one-dot chain line arrow in FIG. 8B (hereinafter may be referred to as a "second direction"), the tooth chipped gear 13 needs to be meshed with the intermediate gear 19 again. In order to satisfy this need, the tooth chipped gear 13 only needs to be rotated integrally with the first pinion gear 12 by the friction between the tooth chipped gear 13 and the first pinion gear 12 rotated in the second direction. However, in order to rotate the tooth chipped gear 13 by the friction between the tooth chipped gear 13 and the first pinion gear 12, there is a need that the tooth chipped gear 13 is completely separated from other loads such as other gears.

In the above-described construction, the second pinion gear 15 rotatable integrally with the tooth chipped gear 13 is not meshed with the first rack gear 17 at the first toothless portion 172. Further, in the state in which the second pinion gear 15 faces the first toothless portion 172, the second pinion gear 15 is rotatable separately from the third pinion gear 16 due to the play formed in a portion of the third pinion gear 16 in which the second pinion gear 15 and the third pinion gear 16 are engaged with each other. That is, the tooth chipped gear 13 is completely separated from the slide cam 11 as the above-mentioned other loads in the state in which the second pinion gear 15 faces the first toothless portion 172. Thus, the tooth chipped gear 13 is rotatable in the second direction integrally with the first pinion gear 12 by the friction between the tooth chipped gear 13 and the first pinion gear 12 in the state in which the second pinion gear 15 faces the first toothless portion 172.

The following problem may arise in the case where the slide cam 11 is separated from the ASF motor, e.g., the case where components, e.g., the tooth chipped gear 13 and the first pinion gear 12, connected only by the friction are located between the slide cam 11 and the ASF motor. When the state of the cap 55 is changed from the state in which the cap 55 is supported on the first guide face 111 to the state in which the cap 55 is supported on the inclined face 113, the force (i.e., the pressing force) of the coil spring 65 acts on the cap 55 at the instant of the change, the force being larger than the friction between the tooth chipped gear 13 and the first pinion gear 12. As a result, there is a risk in which the cap 55 is moved at a relatively high speed in a direction directed from the first position toward the second position.

However, in the above-described embodiment, the first rack gear 17 is provided over an area in which the first toothless portion 172 of the first rack gear 17 is not meshed with the second pinion gear 15 and an area in which the first rack gear 17 is meshed with the second pinion gear 15 in a region in which at least the slide cam 11 supports the cap 55 on the inclined face 113. That is, when the state of the cap 55 is changed from the state in which the cap 55 is supported on the first guide face 111 to the state in which the cap 55 is supported on the inclined face 113, the first rack gear 17 is held in meshing engagement with the second pinion gear 15. Further, the tooth chipped gear 13 is held in meshing engagement with the intermediate gear 19 by being rotated in the second direction integrally with the first pinion gear 12. As a result, the movement of the slide cam 11 is restricted by the ASF motor via the second pinion gear 15 and the tooth chipped gear 13. Thus, it is possible to prevent the cap 55 from being moved at the relatively high speed by the force of the coil spring 65.

<Modification of Embodiment>

In the above-described embodiment, the slide cam 11 directly supports the cap 55, but this multi-function apparatus 1 may be configured such that the slide cam 11 indirectly supports the cap 55.

Figure 10:
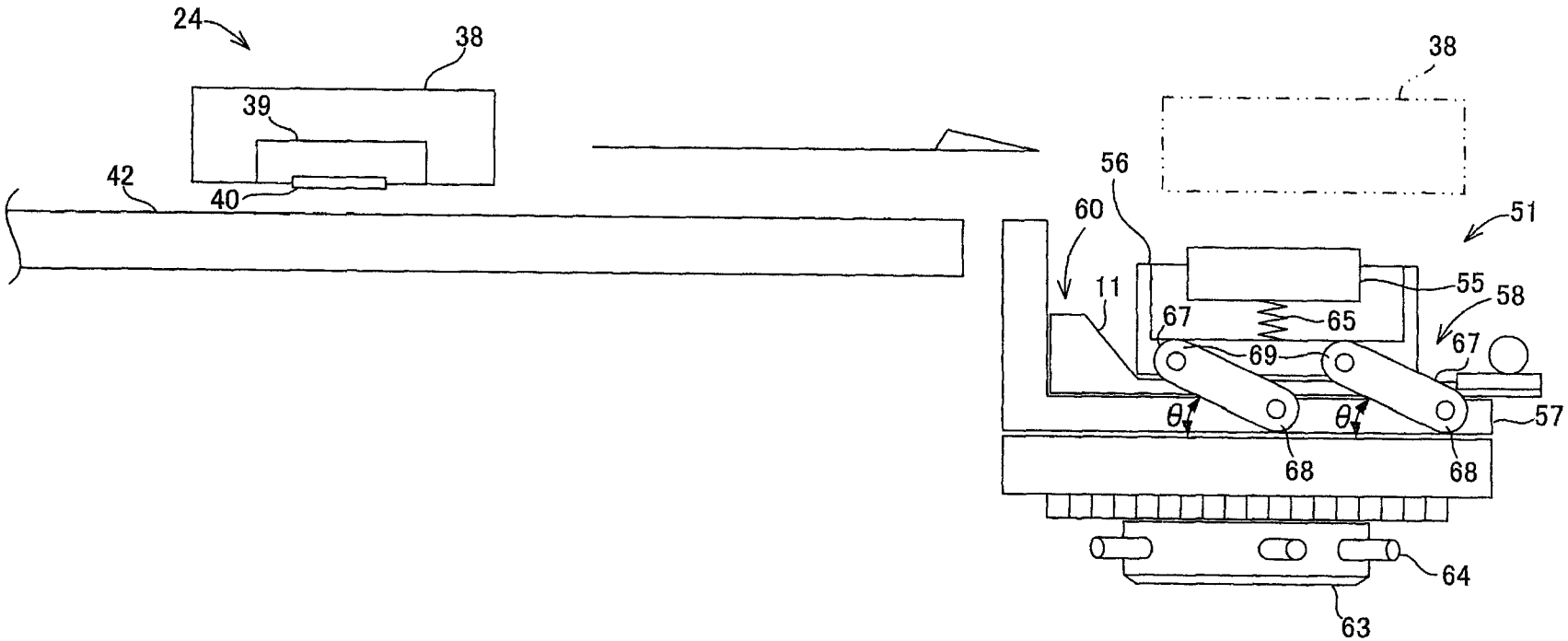
FIG. 10 is a side view schematically showing a side construction of a maintenance mechanism 51 in a modification of the present embodiment.

In this configuration of a multi-function apparatus 1 as a modification of the embodiment of the present invention, as shown in FIG. 10, the maintenance mechanism 51 includes the cap 55, a second frame 56 as a holder, the first frame 57, a parallel link 58, the ink-discharge portion 63, the cam mechanism 60, and so on. There will be explained difference of this modification from the above-described embodiment.

The cap 55 is provided on the second frame 56. Specifically, the cap 55 is supported on a bottom face of the second frame 56 formed in a box shape. In this modification, the cap 55 is elastically supported in the upward and downward direction via the coil spring 65 provided between a lower portion of the cap 55 and the bottom face of the second frame 56. The second frame 56 is supported by the first frame 57. Specifically, the second frame 56 is mounted on the first frame 57 via the parallel link 58.

The parallel link 58 is constituted by four leg portions 67. Two shafts are respectively provided or fitted through opposite ends of each of the leg portions 67. The shaft of one of the opposite ends as one end portion 68 is rotatably mounted on a bottom face of the first frame 57 while the shaft of the other of the opposite ends as the other end portion 69 is rotatably mounted on a lower face of the second frame 56. As a result, the second frame 56 and the cap 55 are movable between (a) the second position at which the second frame 56 and the cap 55 are close to the bottom face of the first frame 57, and an angle θ of the leg portions 67 with respect to the bottom face of the first frame 57 becomes the smallest and (b) the first position at which the second frame 56 and the cap 55 are distant from the bottom face of the first frame 57, and the angle θ becomes the largest.

In this modification, the second frame 56 is moved closer to the bottom face of the first frame 57 until the angle θ becomes about zero degree and the leg portions 67 take an approximately horizontal posture at the second position. Where the second frame 56 is located at the second position, each of the end portions 69 is located at a position nearer to the platen 42 than a corresponding one of the end portions 68 in a rightward and leftward direction in FIG. 10, that is, each end portions 69 is located at a position nearer to the image recording area than the corresponding end portion 68 in the rightward and leftward direction. On the other hand, the second frame 56 is moved away from the first frame 57 until the angle θ becomes about 90 degrees and the leg portions 67 take an approximately upright posture at the first position. Because of this configuration of the leg portions 67, the second frame 56 is disposed at a position nearer to the platen 42 in the rightward and leftward direction when located at the second position, and is disposed at a position furthest from the platen 42 in the rightward and leftward direction when located at the first position. FIG. 10 illustrates the leg portions 67 whose angle θ is more than zero degree for easy understanding purpose. It is noted that this multi-function apparatus 1 is not limited to the above-described configuration in which the leg portions 67 take the approximately horizontal posture and the approximately upright posture. That is, the leg portions 67 at least need to take a posture nearer to the horizontal posture when the second frame 56 is located at the second position, and take a posture nearer to the upright posture when the second frame 56 is located at the first position.

Where the second frame 56 is supported on the slide cam 11, and the coil spring 65 is located between the cap 55 and the second frame 56, the force (i.e., the pressing force) of the coil spring 65 acts on the second frame 56 in the direction directed from the first position toward the second position. However, as in the above-described embodiment, it is possible to prevent, by the cam mechanism 60, the cap 55 from moving at the relatively high speed.

In the above-described embodiment, the multi-function apparatus 1 is configured such that the coil spring 65 forces or presses the cap 55 toward the second position, but the present invention is not limited to this configuration. That is, the coil spring 65 may not be mounted on the cap 55.

In this configuration, the cap 55 moves on and along the inclined face 113 by its own weight when moving from the first position to the second position. Thus, it is possible to reduce a cost because the coil spring 65 is not needed.

In the above-described embodiment, there has been explained that the present invention is applied to the multi-function apparatus 1, but the present invention is also applicable to an image recording apparatus such as an apparatus configure to record a wiring pattern by ejecting metallic materials having conductivity for wiring to a base material.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

In each of the above-described embodiment and modification, the multi-function apparatus 1 is configured such that the lower face of the cap 55 is supported on the first guide face 111 when the cap 55 is located at the first position at which the cap 55 is held in contact with the recording head 39 while the lower face of the cap 55 is supported on the second guide face 112 when the cap 55 is located at the second position at which the cap 55 is distant from the recording head 39, but the present invention is not limited to this configuration. For example, this multi-function apparatus 1 is configured such that the cap 55 is located at the first position at which the cap 55 is held in contact with the recording head 39 in a state in which the lower face of the cap 55 is supported on the first guide face 111 while the cap 55 is located at the second position at which the cap 55 is distant from the recording head 39 in a state in which the lower face of the cap 55 is supported on the inclined face 113. Where this multi-function apparatus 1 is thus configured, the second guide face 112 does not need to be formed on the slide cam 11, thereby simplifying the shape of the slide cam 11 and leading to a lower cost of the multi-function apparatus 1.

Further, in each of the above-described embodiment and modification, the multi-function apparatus 1 is configured such that the second pinion gear 15 is fixed to the tooth chipped gear 13 and rotated integrally with the tooth chipped gear 13, but the present invention is not limited to this configuration. For example, the multi-function apparatus 1 may be configured such that the second pinion gear 15 is rotated about an axis different from that of the tooth chipped gear 13 and rotated via another gear which is rotated integrally with the tooth chipped gear 13. Also in this configuration of the multi-function apparatus 1, the second pinion gear 15 is rotated with the rotation of the tooth chipped gear 13, thereby achieving the same effects as in the above-described embodiment and modification.

Further, in each of the above-described embodiment and modification, the multi-function apparatus 1 is configured such that the projecting portion 151 is formed on the second pinion gear 15 while the recessed portion 161 is formed in the third pinion gear 16, but the present invention is not limited to this configuration. For example, the multi-function apparatus 1 may be configured such that a recessed portion is formed in the second pinion gear 15 while a projecting portion is formed on the third pinion gear 16.

What is claimed is:

1. An image recording apparatus comprising:

a recording head having a liquid ejecting opening and configured to eject liquid therethrough;

a cap configured to be displaced to (i) a first position at which the cap covers the liquid ejecting opening by contacting the recording head and (ii) a second position which is lower than the first position and at which the cap is distant from the recording head;

a slide cam having a cam face intersecting a direction in which the cap is moved and a sliding direction in which the slide cam is moved, the slide cam being configured to displace the cap by moving in the sliding direction intersecting the direction in which the cap is moved;

a first pinion gear having teeth on an external circumference thereof and meshed with a drive gear to which a drive force is transmitted from a drive source;

a tooth chipped gear which is disposed coaxially with the first pinion gear so as to be meshed with the drive gear, and which has teeth having the same pitch as the first pinion gear, the teeth being partly chipped so as not to be meshed with the drive gear;

a first forcing member configured to force at least one of the first pinion gear and the tooth chipped gear in a thrust direction such that the first pinion gear and the tooth chipped gear are pressed to each other;

a second pinion gear configured to be rotated with the tooth chipped gear;

a third pinion gear having play which allows a movement of the second pinion gear in a circumferential direction thereof relative to the third pinion gear, the third pinion gear being configured to be engaged with the second pinion gear and to be meshed with the slide cam over an area thereof between a first moving end portion and a second moving end portion of the slide cam which are respectively one and the other end portions of the area meshed with the third pinion gear;

a first rack gear provided on the slide cam in the direction in which the slide cam is moved and configured to be meshed with the second pinion gear; and a second rack gear provided on the slide cam at a position parallel to the first rack gear and configured to be meshed with the third pinion gear, wherein the first rack gear is configured not to be meshed with the second pinion gear when the second pinion gear faces the first moving end portion of the slide cam at which the slide cam holds the cap at the first position and not to be meshed with the second pinion gear when the second pinion gear faces the second moving end portion of the slide cam at which the slide cam holds the cap at the second position, and configured to be meshed with the second pinion gear in a state in which the slide cam supports the cap on the cam face thereof when a portion of the slide cam which faces the second pinion gear is displaced between the first moving end portion and the second moving end portion, wherein the second rack gear is configured to be meshed with the third pinion gear over the area of the slide cam between the first moving end portion and the second moving end portion, wherein the teeth of the tooth chipped gear are partly chipped such that the second pinion gear faces the area of the slide cam between the first moving end portion and the second moving end portion by the rotation of the tooth chipped gear meshed with the drive gear, and wherein the second pinion gear is configured to be rotated relative to the third pinion gear so as to be rotated due to the play at least until the tooth chipped gear is meshed with the drive gear when the second pinion gear faces the first moving end portion.

2. The image recording apparatus according to claim 1, wherein the slide cam has (i) a first cam face configured to hold the cap at the first position and (ii) a second cam face configured to hold the cap at the second position, and wherein the cam face is configured to connect the first cam face and the second cam face.

3. The image recording apparatus according to claim 1, wherein the tooth chipped gear includes (i) a toothed portion having teeth formed thereon in a circumferential direction of the tooth chipped gear from a first toothed end portion as one of circumferential end parts of the toothed portion to a second toothed end portion as the other of the circumferential end parts of the toothed portion and (ii) a toothless portion having no teeth formed thereon in the circumferential direction of the tooth chipped gear, wherein the slide cam is configured such that the second pinion gear and the first moving end portion face each other when the drive gear is held in meshing engagement with the first toothed end portion, and wherein the first rack gear has no teeth for the mesh of the first rack gear with the second pinion gear, at the first moving end portion of the slide cam.

4. The image recording apparatus according to claim 1, wherein the tooth chipped gear includes (i) a toothed portion having teeth formed thereon in a circumferential direction of the tooth chipped gear from a first toothed end portion as one of circumferential end parts of the toothed portion to a second toothed end portion as the other of the circumferential end parts of the toothed portion and (ii) a toothless portion having no teeth formed thereon in the circumferential direction of the tooth chipped gear, wherein the slide cam is configured such that the third pinion gear and the first moving end portion face each other when the drive gear is held in meshing engagement with the first toothed end portion, and wherein the second rack gear has teeth for the mesh of the second rack gear with the third pinion gear, at the first moving end portion of the slide cam.

5. The image recording apparatus according to claim 1, wherein the tooth chipped gear includes (i) a toothed portion having teeth formed thereon in a circumferential direction of the tooth chipped gear from a first toothed end portion as one of circumferential end parts of the toothed portion to a second toothed end portion as the other of the circumferential end parts of the toothed portion and (ii) a toothless portion having no teeth formed thereon in the circumferential direction of the tooth chipped gear, wherein the slide cam is configured such that the second pinion gear and the second moving end portion face each other when the drive gear is held in meshing engagement with the second toothed end portion, and wherein the first rack gear has no teeth for the mesh of the first rack gear with the second pinion gear, at the second moving end portion of the slide cam.

6. The image recording apparatus according to claim 1, wherein the tooth chipped gear includes (i) a toothed portion having teeth formed thereon in a circumferential direction of the tooth chipped gear from a first toothed end portion as one of circumferential end parts of the toothed portion to a second toothed end portion as the other of the circumferential end parts of the toothed portion and (ii) a toothless portion having no teeth formed thereon in the circumferential direction of the tooth chipped gear, wherein the slide cam is configured such that the third pinion gear and the second moving end portion face each other when the drive gear is held in meshing engagement with the second toothed end portion, and wherein the second rack gear has teeth for the mesh of the second rack gear with the third pinion gear, at the second moving end portion of the slide cam.

7. The image recording apparatus according to claim 1, wherein the second pinion gear includes a projecting portion configured to be engaged with the third pinion gear, wherein the third pinion gear includes a recessed portion configured to guide the projecting portion of the second pinion gear movably in the circumferential direction, and wherein the recessed portion is configured to guide the projecting portion movably in the circumferential direction such that the tooth chipped gear is rotated at least until the tooth chipped gear is meshed with the drive gear when the second pinion gear faces the first moving end portion.

8. The image recording apparatus according to claim 7, wherein the second pinion gear is configured to be meshed with the first rack gear by the movement of the slide cam after the projecting portion of the second pinion gear has been brought into contact with an end part of the recessed portion.

9. The image recording apparatus according to claim 1, further comprising a second forcing member configured to force the cap in a direction toward the second position.

10. The image recording apparatus according to claim 9, further comprising a holder supported by the slide cam and configured to be displaced with the cap, wherein the second forcing member is located between the cap and the holder.

* * * * *